US005388967A

United States Patent [19]

Firnhaber et al.

[11] Patent Number: 5,388,967

[45] Date of Patent: Feb. 14, 1995

[54] COMPRESSOR START CONTROL AND AIR INLET VALVE THEREFOR

[75] Inventors: Mark A. Firnhaber, LaPorte; Sylvester Poplawski, Michigan City, both of Ind.

[73] Assignee: Sullair Corporation, Michigan City, Ind.

[21] Appl. No.: 29,151

[22] Filed: Mar. 10, 1993

[51] Int. Cl.[6] ..... F04B 49/00

[52] U.S. Cl. ..... 417/295; 251/63.4

[58] Field of Search ..... 417/295, 307; 251/63.4

[56] References Cited

U.S. PATENT DOCUMENTS

| | | | |
|---|---|---|---|
| 2,234,488 | 3/1941 | Dick . | |
| 2,997,227 | 8/1961 | Ternent . | |
| 3,260,444 | 7/1966 | Williams et al. . | |
| 3,796,515 | 3/1974 | Lindquist et al. | 417/295 |
| 3,873,239 | 3/1975 | Jamieson | 417/281 |
| 4,068,980 | 1/1978 | Fine et al. | 417/282 |
| 4,406,589 | 9/1983 | Tsuchida et al. | 417/295 |
| 4,708,599 | 11/1987 | Suzuki | 417/295 |
| 4,815,950 | 3/1989 | Aoki et al. | 417/253 |
| 4,968,221 | 11/1990 | Noll | 417/295 |
| 5,009,576 | 4/1991 | Gagnet | 417/295 |

FOREIGN PATENT DOCUMENTS

| | | | |
|---|---|---|---|
| 587917 | 5/1947 | United Kingdom | 417/295 |

*Primary Examiner*—Richard A. Bertsch
*Assistant Examiner*—Alfred Basichas
*Attorney, Agent, or Firm*—Wood, Phillips, VanSanten, Clark and Mortimer

[57] ABSTRACT

A start control for a compressor has an air inlet valve for reducing flow intake when a compressor is started. The valve has a housing with an inlet and an outlet which is connected to a compressor. A rod in the housing is movable relative to the housing and has a shoulder and a piston. A movable plate is mounted on the rod and a spring is interposed between the plate and the housing for biasing the plate toward a closed position in which the housing inlet is at least partially closed. A second spring is interposed between the piston and the housing for moving the shoulder into engagement with the plate and biasing the plate toward the closed position. The housing has a chamber on each side of the piston for receiving air that discharges from the compressor. Air pressure applied to one side of the piston assists the first spring and the second spring move the plate toward the closed position when the compressor is in a start mode of operation. Air pressure applied to a second side of the piston opposes the second spring and reduces bias on the plate whereby the plate is permitted to move away from the closed position when the compressor is in a run mode of operation.

12 Claims, 4 Drawing Sheets

COMPRESSOR START CONTROL AND AIR INLET VALVE THEREFOR

BACKGROUND OF THE INVENTION

1. Technical Field

The present invention is an apparatus for controlling flow into a compressor, and more particularly is a control and a valve for controlling air intake when a compressor is started.

2. Background Art

A rotary screw compressor has a pair of parallel rotors which are rotated oppositely relative to each other by a prime mover, such as an internal combustion engine or an electric motor. The rotors have intermeshed oppositely-pitched helical lands and grooves. Operation of a compressor creates a negative pressure which draws fluid between the rotors and into the grooves. Air in the grooves is compressed when the intermeshed rotors rotate. Compressed air discharges from the grooves and is stored in a receiver tank. A prime mover in some conditions of starting (e.g., cold weather) is not able to supply sufficient torque to rotate the rotors in the compressor unless the prime mover is adequately warmed-up or the load imposed by the compressor is reduced. Air flow into a compressor during starting increases the torque required to start the compressor and results in the application of an increased reaction force to the prime mover which opposes acceleration of the prime mover. Load on a prime mover, such as an internal combustion engine, can prevent the prime mover from starting or from quickly warming-up. It therefore is desirable to reduce the air flow into a compressor during starting to facilitate starting and warm-up of a prime mover which drives the compressor. Control systems, valves, and timing devices have been proposed for controlling flow intake when a compressor is started. Prior flow intake control devices do not adequately restrict flow into a compressor during starting.

SUMMARY OF THE INVENTION

A start control for a compressor operated by a prime mover has an air inlet valve, a control cylinder having a piston connected to a throttle valve on the prime mover, and a warm-up valve which is manually movable between a start position and a run position. In the start position of the warm-up valve, air pressure assists springs in closing the air inlet valve. Air pressure also is applied to the control piston and assists a spring to maintain an idle position. In the run position of the warm-up valve, air pressure opens the air inlet valve and moves the control piston toward an active position. The control piston moves from the idle position to the active position when the warm-up valve is moved from the start position to the run position.

The air inlet valve controls flow into a compressor and has a housing with an inlet and an outlet which is connected to a compressor. A rod in the housing is movable relative to the housing and has a shoulder and a piston. A plate is slidably mounted on the rod and a spring is interposed between the plate and the housing. The spring biases the plate toward a position in which the inlet is closed. A second spring is interposed between the piston and the housing for moving the shoulder into engagement with the plate and biasing the plate to the closed position.

The housing has a chamber on each side of the piston for receiving air discharged from the compressor. Air pressure applied to one side of the piston assists the first spring and the second spring to move the plate toward the closed position when the compressor is in a start mode of operation. Air pressure applied to a second side of the piston opposes the second spring and reduces bias on the plate whereby the plate is permitted to move away from the closed position when the compressor is in a run mode of operation.

Negative pressure develops in the inlet valve housing when the compressor operates. The inlet valve has a port for connecting negative pressure in the housing with the chamber on the second side of the piston so that the negative pressure assists the first spring and the second spring to fully close the inlet.

Air output from a compressor is stored in a tank. A reducing regulator is interposed between the tank and the inlet valve for limiting pressure applied to the inlet valve member when the compressor is in a run mode of operation. A control regulator is interposed between the tank and the inlet valve and the control cylinder for moving the inlet valve member toward the closed position and for moving the control piston toward the idle position when the compressor is in a run mode of operation and pressure in the tank exceeds a predetermined level.

A conduit is connected between negative pressure in the inlet valve and one of the sides of the inlet valve member. A vacuum valve is positioned along the conduit for selectively permitting flow through the conduit and assisting the first spring and the second spring move the plate toward the closed position. A switch on the prime mover is manually operable to open the vacuum valve when the compressor is started.

DESCRIPTION OF THE PRIOR ART

Figures 1, 2:
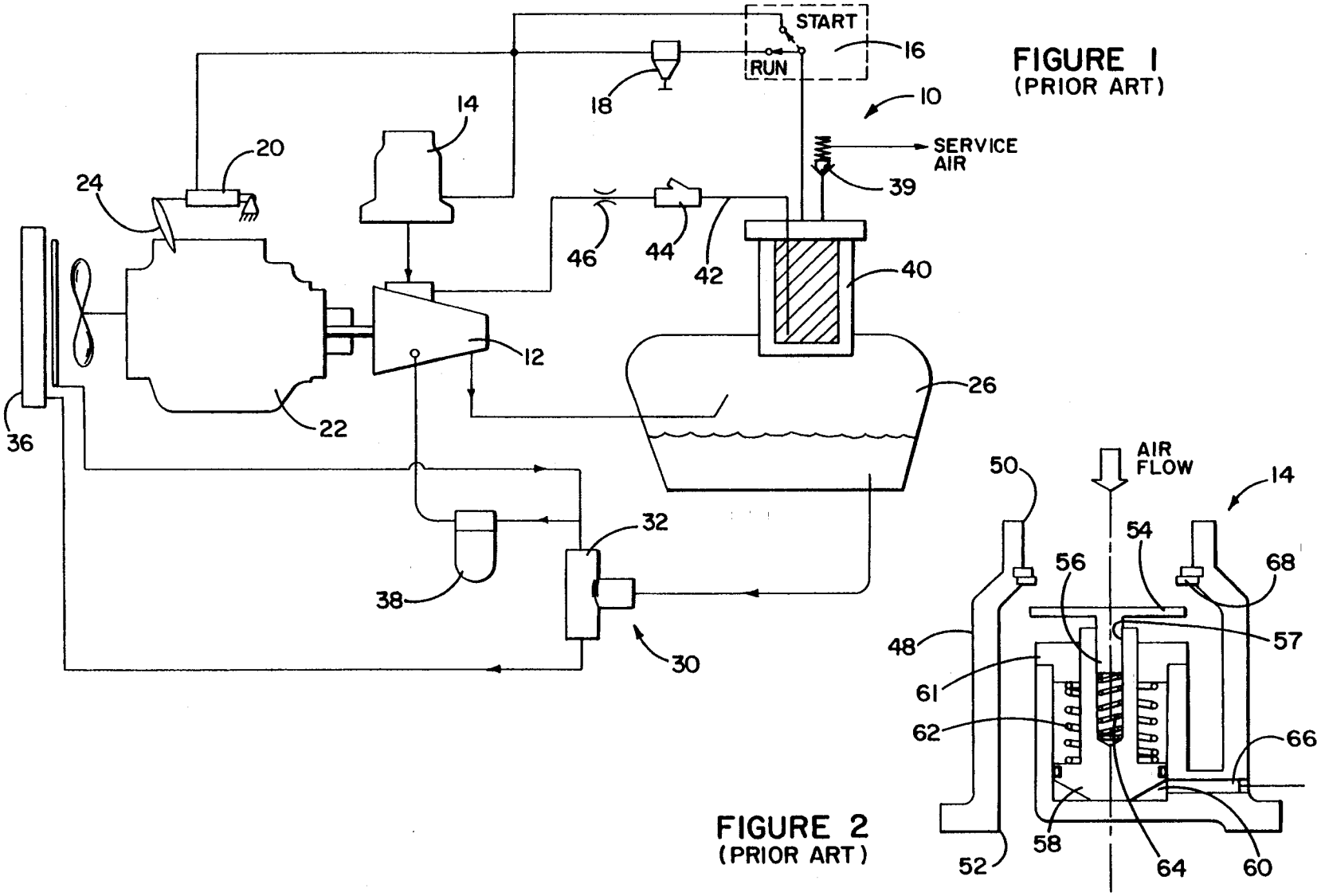
FIGURE 1 (PRIOR ART)
FIGURE 2 (PRIOR ART)
FIG. 1 is a schematic drawing of a prior art start control for a compressor.
FIG. 2 is a sectional view of a prior art air inlet valve in an open position.

FIGS. 1 and 2 show an existing start control, generally designated 10 in FIG. 1, for an air compressor 12. The start control 10 includes an air inlet valve 14, a warm-up valve 16, a control regulator 18, and an engine control cylinder 20. An internal combustion engine 22 is controlled by a throttle 24 and operates the compressor 12. Operation of the compressor 12 causes air which is received from the inlet valve 14 to be compressed and discharged into a receiver tank 26.

An oil circulating system, generally designated 30, is provided for injecting oil into the compressor 12. Oil acts as a sealant and also cools and lubricates the internal components in the compressor 12. The oil circulating system 30 has a temperature control valve 32 which permits oil to flow from the receiver tank 26 to an oil cooler 36. The temperature control valve 32 permits cooled oil to flow through an oil filter 38 and into the compressor 12 for performing the functions stated above. Oil discharges from the compressor 12 in an outlet flow of compressed air. Oil discharged from the compressor 12 accumulates in the receiver tank 26.

Compressed air releases from the receiver tank 26 when a minimum pressure valve 39 opens. Air also is released from the receiver tank 26 through the warm-up valve 16. A separator 40 is provided for removing oil from air which releases from the receiver tank 26. Oil in the scavenge line 42 flows through a strainer 44, through a flow restricting orifice 46, and into the compressor 12. The scavenge line 42 removes oil which has been removed by a separator element and accumulated on the dry side of the separator tank 40. Scavenge oil is returned to a low pressure side of the compressor 12. Operation of the warm-up valve 16 is described below.

FIG. 2 shows the air inlet valve 14 in greater detail. The air inlet valve 14 has a housing 48 with an inlet 50 and an outlet 52. A plate 54 is movably mounted in the housing 48 for opening and closing the valve inlet 50. The plate 54 has a stem 56 which is guided axially in an opening 57 in the end of a piston 58. The piston 58 is biased relative to a cylinder 60 by a spring 62 positioned between the piston 58 and a cylinder end cover 61. The plate 54 is biased relative to the piston by a spring 64 in the opening 57. A passage 66 in the housing 48 directs air from the receiver tank 26 into the cylinder 60.

The engine 22 is started when the warm-up valve 16 is in a start position (dashed arrow in FIG. 1). Negative pressure created by the compressor 12 opens the valve plate 54 against the bias of the spring 64 and draws air through the inlet 50 and into the compressor 12. Pressure increases in the receiver tank 26 when the compressor 12 operates. Air in the receiver tank 26 flows through the passage 66 and into the cylinder 60. When air pressure acting against the piston 58 exceeds the stiffness of the spring 62 and negative pressure created by the compressor 12, the piston 58 moves and closes the valve plate 54 against a valve seat 68.

Air flows from the receiver tank 26 to the engine control cylinder 20 when the warm-up valve 16 is in a start position. Air pressure in the engine control cylinder 20 moves the throttle 24 and decreases output of the engine 22.

The warm-up valve 16 is manually moved to a run position (solid arrow in FIG. 1) after the engine 22 is adequately warmed up. The control regulator 18 is biased toward a closed condition so that air from the receiver tank 26 normally does not flow to the cylinder 66 or to the engine control cylinder 20 when the warm-up valve 16 is in a run position. The spring 64 applies a force which disengages the piston 58 from the valve plate 54 when there is no pressure in the passage 66. The valve plate 54 moves and the valve inlet 50 opens when the negative pressure created by the compressor 12 exceeds the stiffness of the spring 64.

The control regulator 18 opens when pressure of air in the receiver tank 26 exceeds a predetermined level, such as when the compressor 12 is operated and service air is not released from the receiver tank 26. Air in the receiver tank 26 flows into the cylinder 60 when the control regulator 18 opens. Air pressure moves the piston 58 in opposition to the bias of the springs 62 and negative pressure created by the compressor 12. The piston 58 engages the valve plate 54 and at least partially closes the valve inlet 50. Air also flows into the engine control cylinder 20. Air pressure moves the throttle 24 and decreases the output of the engine 22.

The control regulator 18 closes when the pressure of air in the receiver tank 26 is below the threshold of the control regulator 18. Pressure is removed from the passage 66 and negative pressure created by the compressor 12 opens the valve plate 54 when the control regulator 18 closes. Pressure is removed from the engine control cylinder 20 and the throttle 24 is moved toward a full speed position.

A problem with the prior start control 10 and air inlet valve 14 is that air is admitted into the compressor 12 when the engine 22 is started. The inlet valve 14 does not close until pressure of air in the receiver tank 26 increases so that force applied by the air pressure exceeds the stiffness of the spring 62 and the negative pressure created by the compressor 12. Air flow into the compressor 12 increases the load placed on the engine 22 during starting and thus increases the amount of torque required to begin operating the compressor 12. Increased torque requirements, particularly during crank start-up of the internal combustion engine 22 can prevent the engine 22 from starting.

DESCRIPTION OF THE PREFERRED EMBODIMENT

Figure 3:
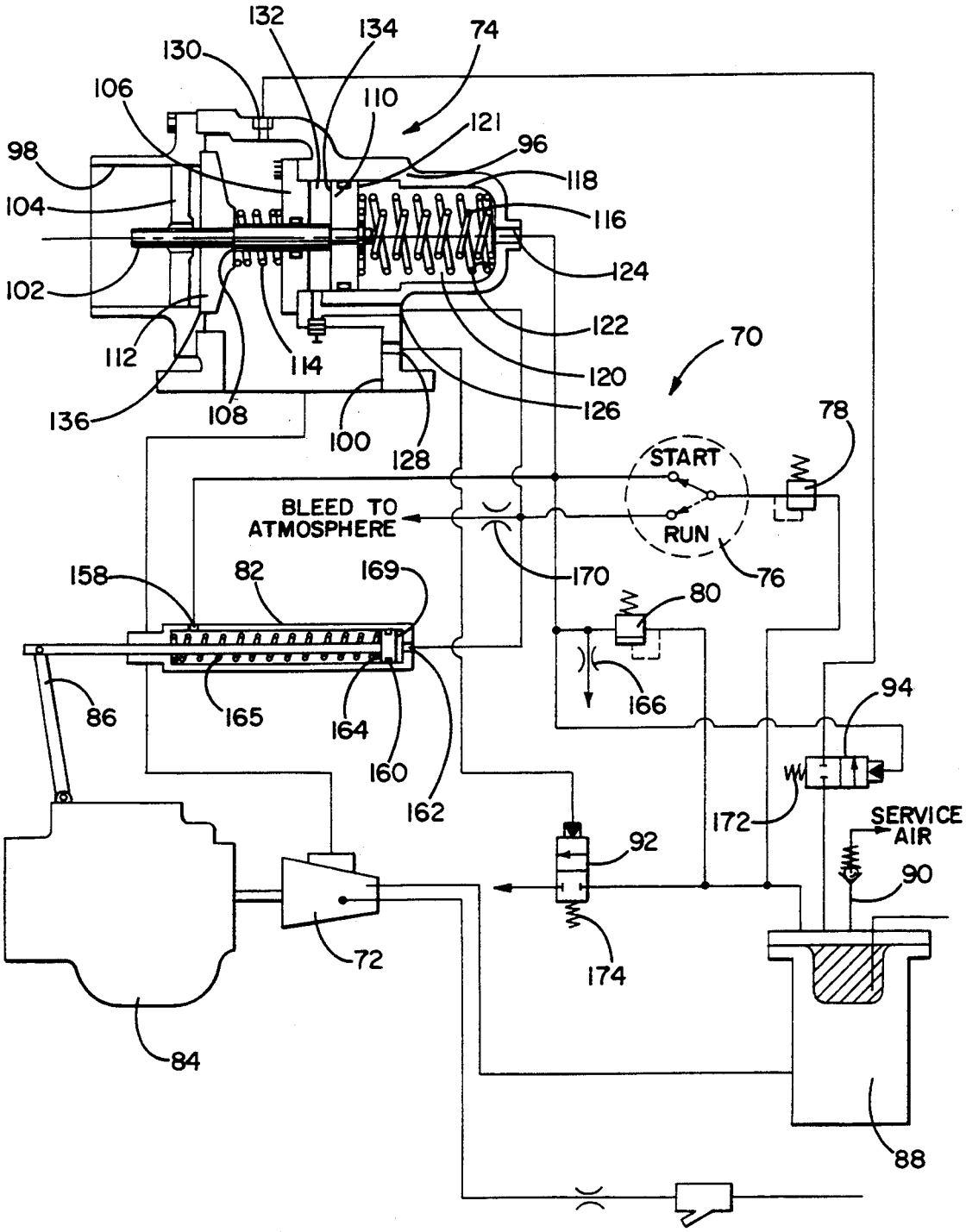
FIG. 3 is a schematic drawing of a start control and air inlet valve according to the present invention.

FIG. 3 shows a start control, generally designated 70, for an air compressor 72. The start control 70 includes an air inlet valve 74, a warm-up valve 76, a reducing regulator 78, a control regulator 80, and a control cylinder 82. A prime mover, such as an internal combustion engine 84, operates the compressor 72 and has a throttle valve controlled by a lever 86. The compressor 72 alternatively can be operated by an electric motor wherein the control cylinder 82 is omitted and control of the motor is achieved with an electrical speed control. The control cylinder 82/electrical speed control is eliminated entirely in an application in which it is desired that the prime mover operate at a constant speed. Operation of the compressor 72 causes air which is received from the air inlet valve 74 to be compressed and discharged into a receiver tank 88.

Operation of the start control 70 is summarized generally as follows. During starting springs 116 and 118 act on the piston 110, rod 102, and plate 112 to keep the valve 74 closed. Only when sufficient vacuum has been generated in the inlet duct of the compressor 72 is the air inlet valve 74 allowed to open slightly against the force of springs 116 and 118. With the air inlet valve 74 thus closed during starting load on the prime mover 84 is reduced. The warm-up valve 76 is manually movable between a start position and a run position. The warm-up valve 76 is placed in the start position before starting the prime mover 84. Air pressure fully closes the air inlet valve 74 when the warm-up valve 76 is in the start position and system pressure increases to 25 psig. During starting the engine control cylinder 82 maintains the engine 84 at idle. Air pressure also is supplied to the control cylinder 82 to assist the spring to maintain the engine throttle lever 86 in the idle position. The warm-up valve 76 is moved to the run position after the prime mover 84 is suitably warmed up. Air pressure opens the air inlet valve 74 and moves the throttle lever 86 toward an active position when the warm-up valve 76 is in the run position.

Details of an oil circulating system are omitted from the start control 70 shown in FIG. 3 to facilitate an understanding of the present invention. It should be understood, however, that the invention contemplates the provision of conventional oil circulating system, such as the oil circulating system 30 discussed above with regard to the prior art start control 10.

Compressed air releases from the receiver tank 88 through a minimum pressure valve 90 and a blow down valve 92. Air also releases from the receiver tank 88 through the warm-up valve 76 and the control regulator 80. The present start control 70 has a recirculation valve 94. The recirculation valve 94 permits scavenge air to flow from the receiver tank 88 through the air inlet valve 74 and into the compressor 72. Scavenge air removes residual oil which is trapped in the compressor 72 when the air inlet valve 74 closes.

The air inlet valve 74 has a housing 96 with an inlet 98 and an outlet 100 connected to the compressor 72. A rod 102 in the housing 96 is mounted movably on two guides 104 and 106 fixed to the housing 96. The rod 102 has shoulder 108. A piston 110 is secured to an end of the rod 102 in the housing 96. A plate 112 is slidable on the rod 102 and a spring 114 is interposed between the plate 112 and the guide 106. The spring 114 biases the plate 112 toward the inlet 98. Coaxial springs 116 and 118 are positioned in a chamber 120 between the piston 110 and an end wall 122 of the housing 96. The springs 116 and 118 apply a force to one side 121 of the piston 110 and urge the shoulder 108 on the rod 102 into engagement with the plate 112. The springs 116 and 118 thereby assist the spring 114 to bias the plate 112 toward the inlet 98.

A plurality of ports or openings 124, 126, 128 and 130 are provided in the outer wall of the housing 96. The port 124 connects the warm-up valve 76 with the chamber 120. The port 126 connects the warm-up valve 76 and the engine control cylinder 82 with a chamber 132 between the guide 106 and an opposite side 134 of the piston 110. The port 128 connects the outlet 100 with the blow down valve 92. The port 130 connects the outlet 100 with the recirculation valve 94.

The above described operation of the start control 70 is achieved as follows. The engine 84 is started when the warm-up valve 76 is in the start position (solid arrow in FIG. 3). Operation of the compressor 72 creates a negative pressure in the outlet 100 of the valve housing 96. Negative pressure draws air into the valve housing 96 through the inlet 98. Force applied by the springs 114, 116 and 118 exceeds the negative pressure created by the compressor 72 and holds the valve plate 112 in a closed position wherein the inlet 98 is at least partially closed. Air from the receiver tank 88 flows into the chamber 120 through the port 124 and assists holding the valve plate 112 closed when the warm-up valve 76 is in the start position. The stiffness of the springs 114,116 and 118 is selected so that the valve plate 112 is held against a seat 136 in the housing 96 when negative pressure created by the compressor 72 equals approximately eighteen inches of mercury.

Air in the receiver tank 88 flows to an end 158 of the engine control cylinder 82 when the warm-up valve 76 is in a start position. A control piston 160 in the cylinder 82 is connected to the throttle lever 86. The control piston 160 has an idle position (in which the piston 160 is positioned in the right end 162 of the cylinder 82 in FIG. 3) and an active position (in which the piston 160 is positioned in the left end 158 of the cylinder 82 in FIG. 3). Air admitted into the end 158 of the engine control cylinder 82 applies pressure against one side 164 of the piston 160 and together with a spring 165 maintains the piston 160 in the idle position. Output of the engine 84 is maintained at idle speed when the piston 160 is in the idle position.

The warm-up valve 76 manually is moved to a run position (dashed arrow in FIG. 3) after the engine 84 is adequately warmed up. When the warm-up valve 76 is in the run position, air from the receiver tank 88 flows into the chamber 132 through the port 126. Air pressure in the chamber 132 applies a force against the side 134 of the piston 110 in opposition to the bias of the springs 116 and 118. Air pressure in the chamber 132 thereby permits negative pressure at the outlet 100 to move the plate 112 axially away from the closed position when the compressor 72 is in a run mode of operation. Air in the chamber 120 is forced out of the port 124 and discharges through a bleed orifice 166 when the valve plate 112 moves away from the closed position.

Air from the receiver tank 88 flows into the end 162 of the engine control cylinder 82 when the warm-up valve 76 is in the run position. Air admitted into the end 162 of the engine control cylinder 82 applies pressure against a side 169 of the engine control piston 160 and moves the piston 160 toward the active position. Output of the engine 84 increases when the piston 160 moves toward the active position. Air in the left end of the engine control cylinder 82 discharges through the bleed orifice 166 when the piston 160 moves toward the active position.

The reducing regulator 78 prevents air from flowing to the air inlet valve 74 when pressure of the air exceeds a predetermined level and the warm-up valve 76 is in the run position. In the preferred embodiment the reducing regulator 78 prevents air from flowing to the air inlet valve 74 when pressure of the air exceeds approximately 50 psig and the warm-up valve 76 is in the run position.

The control regulator 80 normally is closed and opens when pressure in the receiver tank 88 exceeds a predetermined level, such as when the compressor 72 is operated and service air is not released from the receiver tank 88. Air from the receiver tank 88 flows through the port 124 and into the chamber 120 when the control regulator 80 opens. Air pressure against the side 121 of the piston 110 engages the shoulder 108 on the rod 102 with the plate 112 and moves the plate 112 toward the closed position. Air in the chamber 132 is forced out of the housing 96 through the port 126 and discharges through a bleed orifice 170.

Air from the receiver tank 88 flows into the left end 158 of the engine control cylinder 82 and moves the engine control piston 160 toward the idle position. Air is forced out of the right end 168 of the engine control cylinder 82 and discharges through the bleed orifice 170.

The recirculation valve 94 normally is closed and opens when pressure in the chamber 120 in the housing 96 applies a force which exceeds the stiffness of a recirculation valve spring 172. Scavenge air flows from the receiver tank 88 and into the compressor 70 through the port 130 in the housing 96 when the recirculation valve 94 opens.

The blow down valve 92 normally is closed and opens when pressure in the outlet 100 applies a force which exceeds the stiffness of a blow down valve spring 174. Air is released from the receiver tank 88 when the blow down valve 92 opens. Pressure in the outlet 100 becomes excessive, for example, when the compressor 70 ceases operating and the air inlet valve 74 is closed. The blow down valve 92 thus is operative to relieve pressure in the receiver tank 88 when the compressor 72 is shut down.

Figure 4:
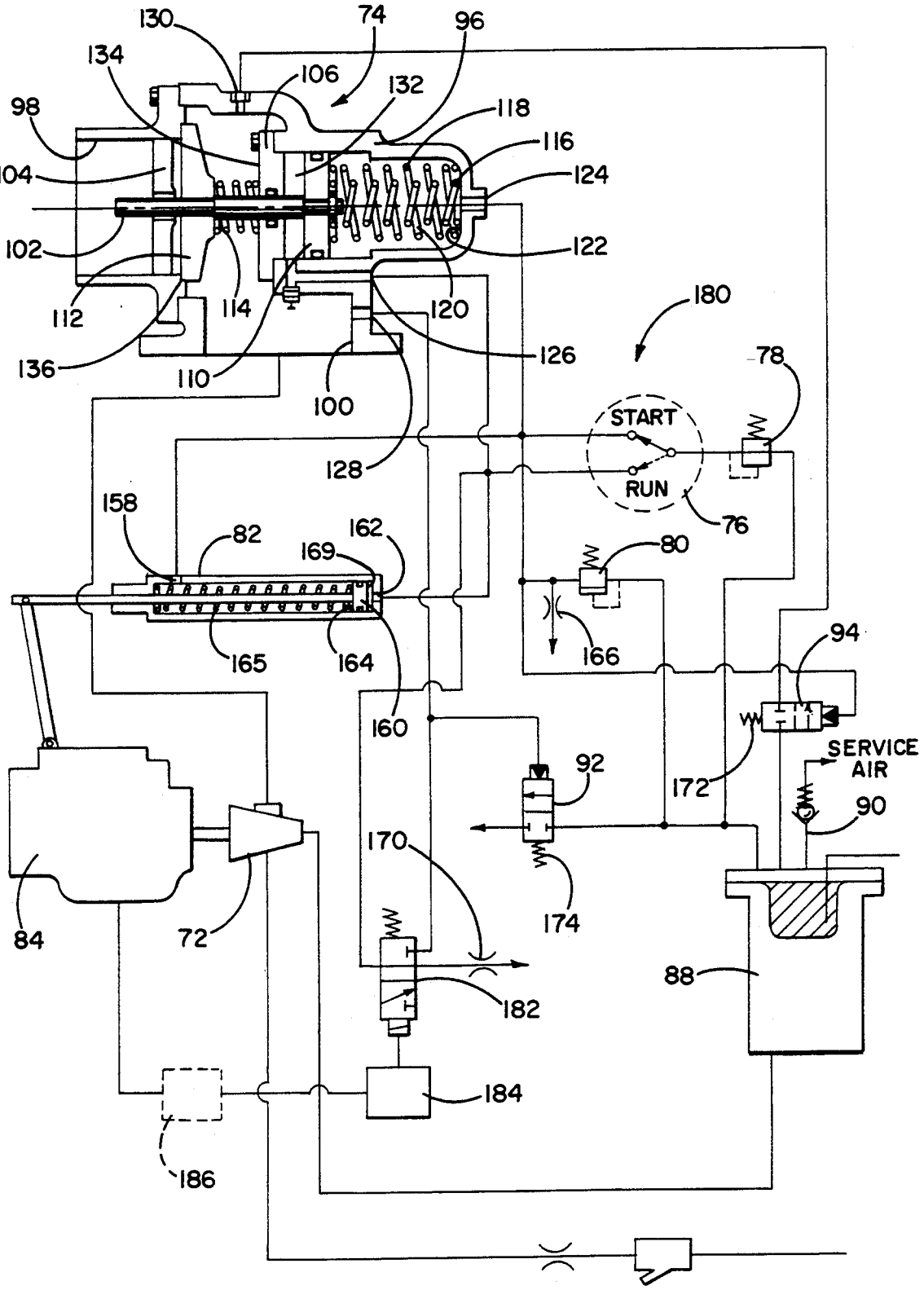
FIG. 4 is a schematic drawing of an alternative start control.

An alternative start control, generally designated 180 in FIG. 4, employs the components described above with respect to the start control 70. In particular, the start control 180 includes the air inlet valve 74, the control regulator 80, the engine control cylinder 82. The start control 180 also has the minimum pressure valve 90, the blow down valve 92, and the recirculation valve 94.

A distinction between the start control 70 described with respect to FIG. 3 and the start control 180 in FIG. 4 is that a vacuum valve 182 is interconnected between the port 126 and the port 128 when the warm-up valve 76 is in the start position for selectively applying negative pressure from the outlet 100 of the air inlet valve 74 to the chamber 132. That is, operation of the compressor 72 creates negative pressure in the outlet 100. The vacuum valve 182 normally is in a closed position. A switch 184 is provided for manually opening the vacuum valve 182 whereby negative pressure in the inlet valve housing outlet 100 draws air through the port 126. Negative pressure in the chamber 132 draws the piston 110 to the left in FIG. 4 and assists the springs 114, 116 and 118 to hold the valve plate 112 in a closed position.

The switch 184 is of any type suitable for holding the vacuum valve 182 open when the engine 84 is started. For example, the engine 84 can have a shutdown control 186 whereby the engine ceases operating when oil pressure in the engine exceeds a predetermined level, such as when engine oil overheats. The shutdown control 186 can have a manual override switch for avoiding shut down when the engine 84 is started. The invention contemplates that the switch 184 be coupled with an override switch so that when an engine shut down signal is overridden the vacuum valve 182 is held open during starting.

Figure 5:
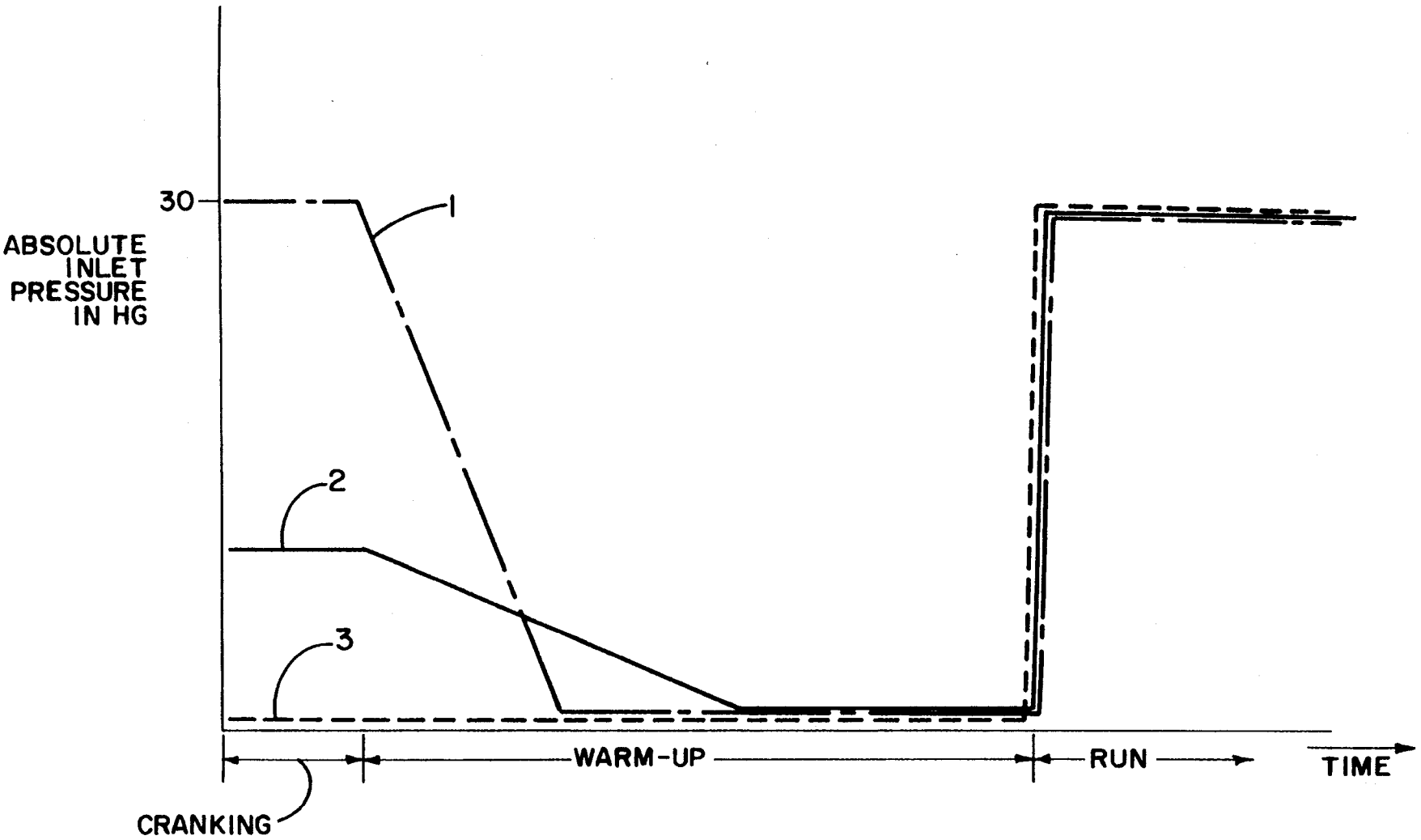
FIG. 5 is a plot of compressor inlet pressure as function of operating conditions for the start controls shown in FIGS. 1, 3 and 4.

FIG. 5 graphically compares the performance of the prior art start control 10 shown in FIG. 1 with the performance of the start control 70 shown in FIG. 3 and the start control 180 shown in FIG. 4.

Torque required from a prime mover to operate a compressor is proportional to the absolute pressure at the inlet of the compressor. Curve 1 in FIG. 5 represents the inlet pressure of a compressor using the prior art start control 10 (FIG. 1) and employing the prior air inlet valve 14 (FIG. 2). Curve 2 in FIG. 5 represents the inlet pressure of a compressor using the present start control 70 (FIG. 3) and employing the air inlet valve 74. The difference between Curve 1 and Curve 2 represents an approximate 85% decrease in torque applied to a prime mover during cranking (starting) of a compressor.

Curve 3 in FIG. 5 represents the inlet pressure of a compressor using the alternative start control 180 (FIG. 4). The start control 180 provides a relative low, constant inlet air pressure when a compressor is started.

We claim:

1. A valve for controlling flow to a compressor, comprising:

a housing having an inlet, and an outlet connected to a compressor;

a rod in the housing a shoulder on the rod;

means for mounting the rod for movement relative to the housing;

a plate movable along the rod;

a first spring between the plate and the housing for biasing the plate toward a closed position in which the housing inlet is at least partially closed;

a piston on the rod, said piston having opposed sides;

a second spring between the piston and the housing for moving the shoulder into engagement with the plate and biasing the plate toward said closed position;

a chamber in the housing on one of said piston sides for receiving air discharged by the compressor, said air having a pressure that acts against the piston and assists the first spring and the second spring move the plate toward the closed position when the compressor is in a start mode of operation; and a chamber in the housing on the other said piston sides for receiving air discharged by the compressor, said air having a pressure that acts against the piston in opposition to the second spring and reduces bias on the plate whereby the plate is permitted to move away from the closed position when the compressor is in a run mode of operation.

2. The valve of claim 1 in which the housing has an opening for admitting air discharged by compressor into the chamber on the one side of said piston.

3. The valve of claim 1 in which the housing has an opening for admitting air discharge by the compressor into the chamber on the other side of said piston.

4. The valve of claim 1 in which negative pressure develops in the housing when the compressor is started, the housing having means for connecting said negative pressure to the chamber on the other side of said piston whereby the negative pressure assists the first spring and the second spring to move the plate toward the closed position.

5. A start control for a compressor operated by a prime mover, the prime mover having a throttle positionable to control operation of the compressor, the compressor discharging an outlet flow into a tank, the start control comprising:

an inlet valve for admitting air to the compressor, the inlet valve comprising a housing having a member movable therein between a first position in which the inlet valve is at least partially closed and a second position in which the inlet valve is open, said inlet valve member having opposed sides;

means for biasing the inlet valve member toward the first position thereof, said biasing means being located in said housing;

a control cylinder having a control piston therein operatively engaged with the throttle of a prime mover, the control piston having opposed sides and being movable between an idle position and an active position;

means for selectively connecting the tank with either of said opposed sides of the inlet valve member and either of said opposed sides of the control piston, said means including a warm-up valve manually movable between a) a start position in which pressure of air in the tank is applied to one of the sides of the inlet valve member to move said inlet valve member toward the first position and in which pressure of air in the tank is applied to one of the sides of the control piston to move said control piston toward the idle position when the compressor is in a start mode of operation, and b) a run position in which pressure of air in the tank is applied to the other of said opposed sides of the inlet valve member to move said inlet valve member toward the second position and in which pressure of air in the tank is applied to the other of said opposed sides of the control piston to move said control piston toward the active position when the compressor is in a run mode of operation.

6. The start control of claim 5 including means for automatically moving the control piston from the idle position to the active position when the warm-up valve is moved from the start position to the run position.

7. The start control of claim 5 including a regulator interposed between the tank and the inlet valve, the regulator limiting air presstire from the tank applied to said inlet valve when the compressor is in a run mode of operation.

8. The start control of claim 5 including a regulator interposed between the tank and the inlet valve and the control piston for moving the inlet valve member toward the first position and for moving the control piston toward the idle position when the compressor is in a run mode of operation and the pressure of air in the tank exceeds a predetermined level.

9. A start control for a compressor operated by positionable to control operation of the compressor, operation of the compressor creating a negative pressure, the compressor discharging an outlet flow into a tank, the start control comprising:

an inlet valve for admitting a flow of air to the compressor, the inlet valve comprising a housing having a member movable therein between a first position in which the inlet valve is at least partially closed and a second position in which the inlet valve is open, said inlet valve member having opposed sides;

means for biasing the inlet valve member toward the first position thereof, said biasing means being located in said housing;

a control cylinder having a control piston therein operatively engaged with the throttle of a prime mover, the control piston having opposed sides and being movable between an idle position and an active position;

means for selectively connecting the tank with either of said opposed sides of the inlet valve member and either of said opposed sides of the control piston;

a warm-up valve manually movable between a) a start position in which pressure of air in the tank is applied to one of the sides of the inlet valve member to hold said inlet valve member in the first position and in which pressure of air in the tank is applied to one of the sides of the control piston to move said control piston toward the idle position when the compressor is in a start mode of operation, and b) a run position in which pressure of air in the tank is applied to the other of said opposed sides of the inlet valve member to move said inlet valve member toward the second position and in which pressure of air in the tank is applied to the other of said opposed sides of the control piston to move said control piston toward the active position when the compressor is in a run mode of operation; and a means for selectively applying negative pressure to the one of said opposed sides of the inlet valve member to bias the inlet valve member toward said first position.

10. The control of claim 9 in which the inlet valve is closed when the inlet valve member is in the first position.

11. The control of claim 9 in which said means for applying negative pressure comprises a conduit connected with negative pressure in the inlet valve and the other side of the inlet valve member, and further comprising a vacuum valve for selectively permitting flow through the conduit.

12. The control of claim 11 including a switch operatively associated with the prime mover for opening the vacuum valve when the compressor is started.

* * * * *